United States Patent [19]

Kutsumura et al.

[11] Patent Number: 4,683,031

[45] Date of Patent: Jul. 28, 1987

[54] HOT COKE RECEIVING DEVICE

[75] Inventors: Shoji Kutsumura, Hokkaido; Touichi Isonaga, Shiga, both of Japan

[73] Assignees: Nippon Steel Corp., Hokkaido; Fujicar Manu. Co. Ltd., Shiga, both of Japan

[21] Appl. No.: 839,287

[22] Filed: Mar. 13, 1986

Related U.S. Application Data

[62] Division of Ser. No. 653,768, Sep. 24, 1984.

[30] Foreign Application Priority Data

| | | | |
|---|---|---|---|
| Sep. 26, 1983 | [JP] | Japan | 58-148667 |
| Jun. 1, 1984 | [JP] | Japan | 59-81779 |
| Jun. 1, 1984 | [JP] | Japan | 59-81780 |
| Aug. 17, 1984 | [JP] | Japan | 59-171293 |
| Aug. 17, 1984 | [JP] | Japan | 59-171294 |

[51] Int. Cl.[4] ..... C10B 39/12; C10B 39/14

[52] U.S. Cl. ..... 202/227; 202/230; 202/262; 202/270; 294/68.22; 294/68.24

[58] Field of Search ..... 202/227, 228, 239, 262, 202/263, 266, 270; 414/185, 191, 199, 287, 288, 403, 411, 414; 212/166; 294/68.22, 68.24; 222/181, 185, 505, 544, 556, 557

[56] References Cited

U.S. PATENT DOCUMENTS

| | | | |
|---|---|---|---|
| 834,305 | 10/1906 | Kozora | 294/68.22 |
| 2,381,103 | 8/1945 | Briner | 294/68.24 |
| 2,535,179 | 12/1950 | Wallsworth et al. | 294/68.24 |
| 2,784,025 | 3/1957 | Beckenbach | 294/68.22 |
| 2,856,223 | 10/1958 | Weaver | 294/68.24 |
| 3,418,019 | 12/1968 | Fadler | 294/68.24 |
| 4,009,081 | 2/1977 | Ueda et al. | 202/227 |
| 4,392,919 | 7/1983 | Galow et al. | 202/228 |

*Primary Examiner*—Barry S. Richman
*Assistant Examiner*—Joye L. Woodard
*Attorney, Agent, or Firm*—Cushman, Darby & Cushman

[57] ABSTRACT

A hot coke receiving device of a type having a coke bucket body which has a cylindrical or polygonal form with a discharge gate provided in the bottom thereof, and having the coke bucket turnably mounted on a bucket car, said receiving device comprising: a ring-like horizontal frame surrounding the outer periphery of the coke bucket body without contact therebetween, said frame being connected to the discharge gate by means of a pair of rods and a pair of pins; a pair of outwardly projecting trunnions disposed at opposing points on the said ring-like horizontal frame; a pair of vertical hanger beams secured at opposing positions near but apart from the positions of said trunnions; said vertical beams having a projecting block which engages with said trunnion.

3 Claims, 24 Drawing Figures

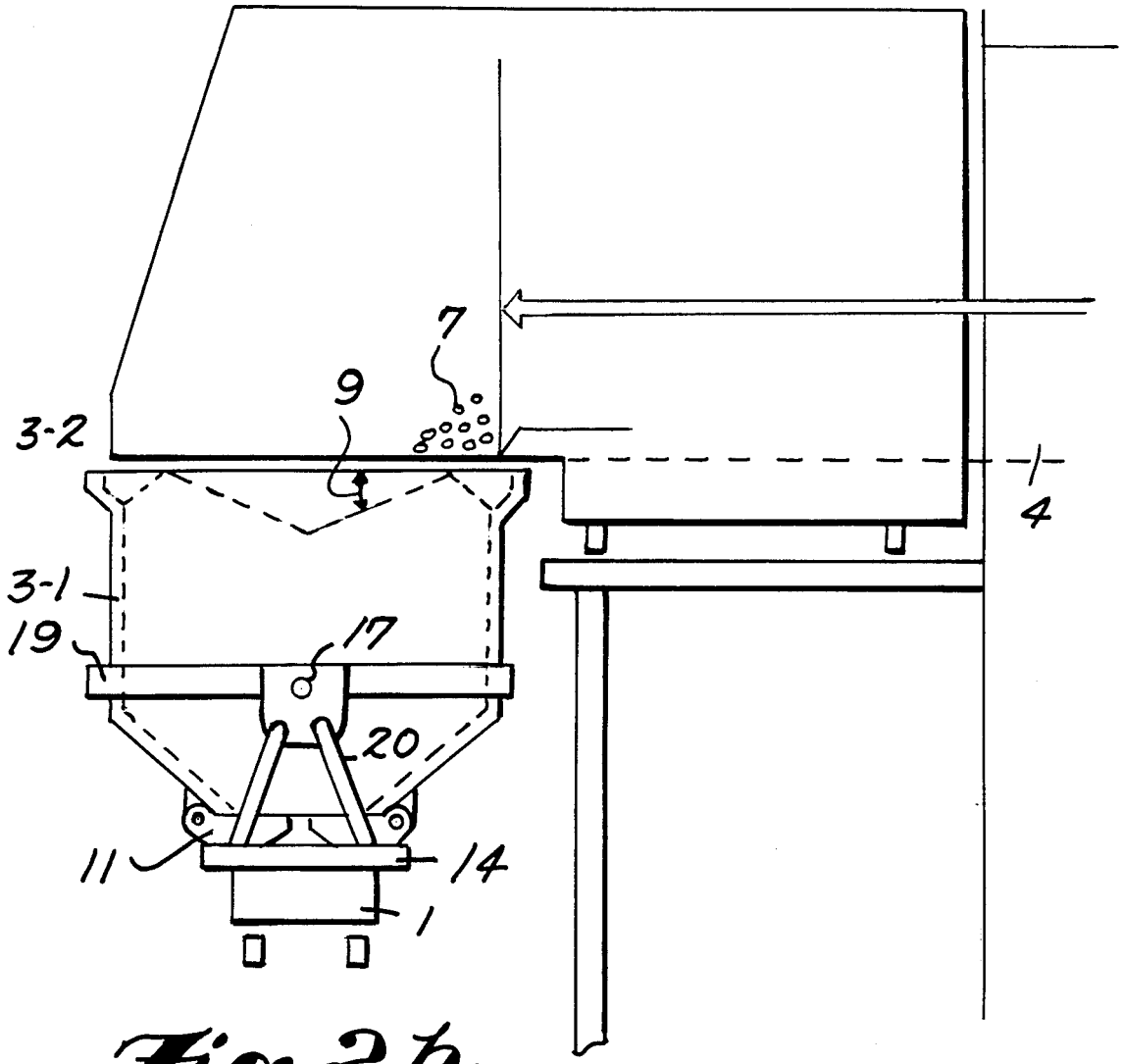
Fig. 2b.
Fig. 3.
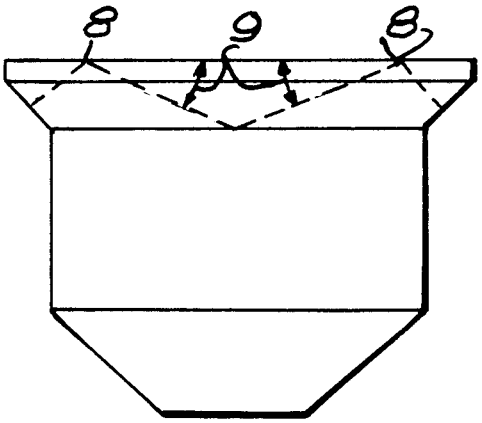

Fig. 4a.
Fig. 4b.
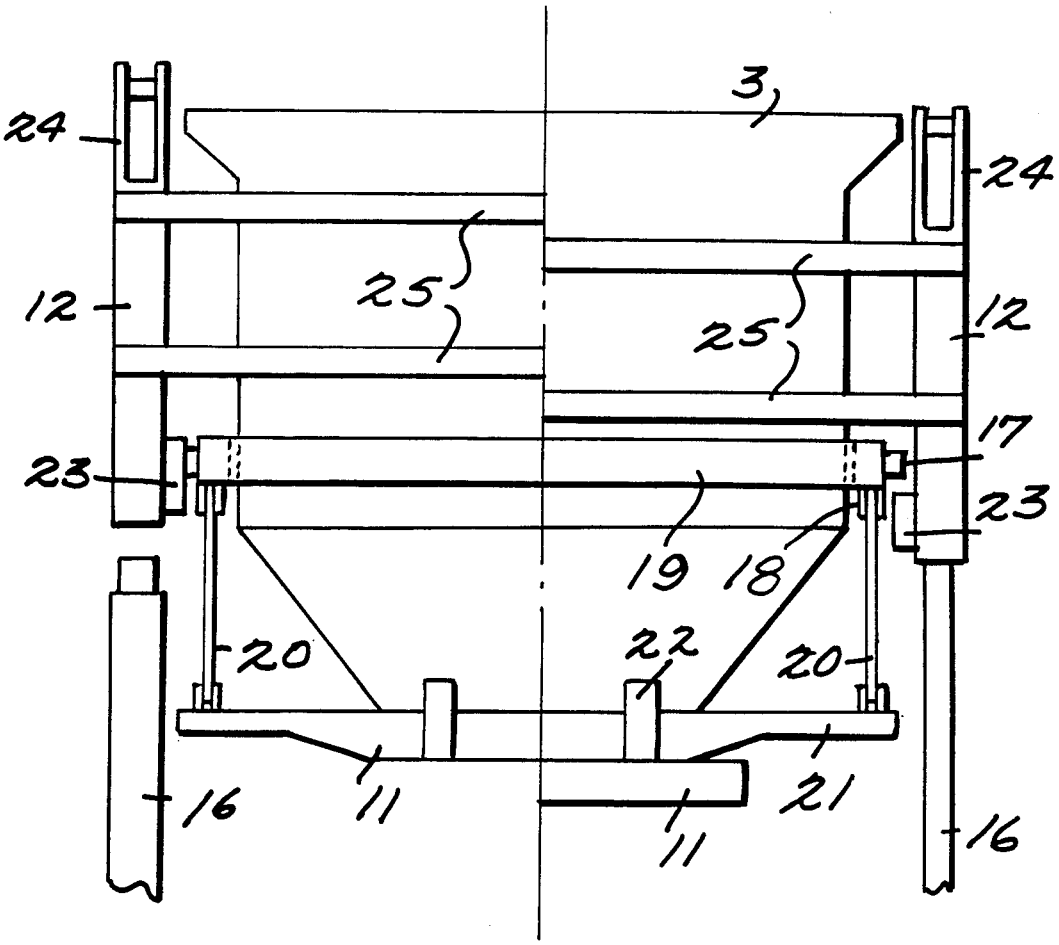
Fig. 4c.
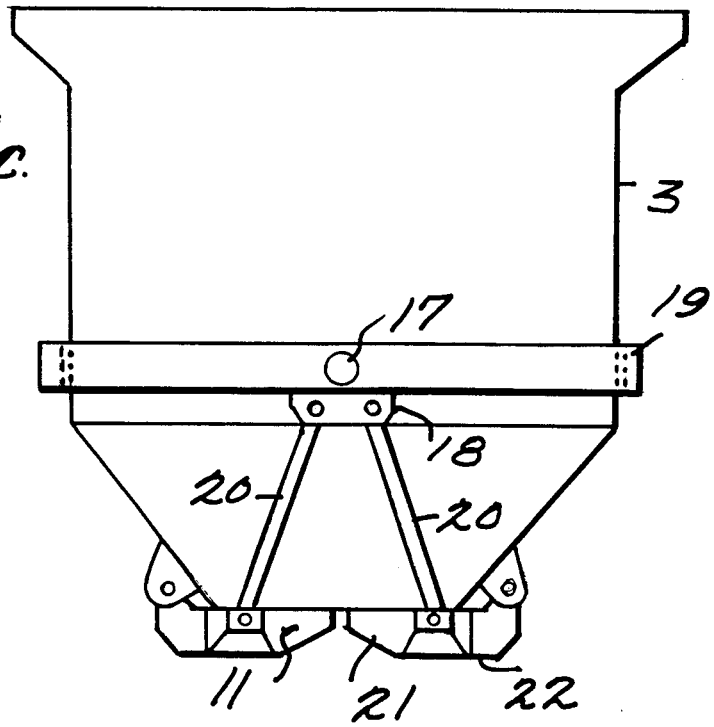

HOT COKE RECEIVING DEVICE

This is a division, of application Ser. No. 653,768, filed Sept. 24, 1984.

BACKGROUND OF THE INVENTION

1. Field of the Invention

This invention relates to a hot coke receiving device for a coke oven, particularly a coke oven of a dry quenching type.

2. Description of the Prior Art

Dry quenching facilities for coke are generally arranged as follows: Hot coke discharged from a coke oven is received by a coke bucket which is mounted on a bucket car that travels on rails and is thus transported to a hoisting tower. The coke bucket is hoisted by a crane to a point above a pre-chamber of the dry quenching facility. Then, a coke discharge gate which is provided in the bottom of the coke bucket is opened to charge the inside of the pre-chamber with the hot coke. The hot coke is quenched by the dry quenching facility. The sensible heat of the hot coke is effectively utilized for obtaining steam, for example, with a boiler for power generation within the coke oven system. Meanwhile, after the hot coke is discharged, the coke bucket is again put on the bucket car in preparation for the next discharge operation of the coke oven. The coke bucket is thus repeatedly used for transporting the hot coke.

FIGS. 1(*a*) and 1(*b*) of the accompanying drawings show the conventional arrangement of the coke bucket and the bucket car. As shown, a rectangular coke bucket 3A which is provided with a rectangular coke receiving plate 2 is mounted on a bucket car 1. The car 1 is pulled by an electric car 31 to a predetermined position at an opening provided in the coke oven before the discharge operation takes place. Then, the coke 5 which is pushed out via a coke guide from the coke oven 4 is received by the bucket 3A while the bucket travels at a low speed within the range of an effective length l of the bucket. However, in the existing coke ovens, the coke falling point 6 is located extremely close to the coke oven and the shape of the coke thus received after loading is lop-sided toward the coke oven side of the bucket due to an angle of repose 29 as shown in FIGS. 8(*a*) and 8(*b*). As a result, the ratio of the effective loading volume of coke to the total capacity of the coke bucket 3A has been extremely low.

Further, as apparent from the loaded shape, the coke creates an unbalanced load. The unbalanced load necessitates provision of a balance weight on one side of the coke bucket 3A opposite to the coke oven side at the time when the coke bucket 3A is to be hung up by the crane at the hoisting tower. The provision of the balance weight then increases the total weight of the coke bucket.

To solve these problems, a coke bucket car was disclosed in Japanese Utility Model Publication No. Sho 54-39483, in which: A turn-table is provided on the coke bucket car and the coke bucket is disposed on the turntable. According to this prior art arrangement, the capacity of the coke bucket can be reduced as the coke can be received while the turn-table rotates with the coke bucket placed thereon. Since the lopsided load can be thus avoided, the occurrence of tumbling of the coke bucket car at the curved portions of the rails can be prevented as mentioned in the utility model publication.

However, since the coke bucket car disclosed in Japanese Utility Model Publication No. Sho 54-39483 is arranged to have the turn-table on the car, it has the following shortcoming: The coke which falls through a cleavage around the discharge gate and the dust which floats during a discharge operation of the coke oven accumulates on the turn-table, thus hindering the stably mounted state and smooth rotation of the coke bucket. This shortcoming of the prior art arrangement has necessitated the use of human labor or compressed air for the removal of accumulated dust.

As the coke bucket rotating mechanism, Australian Patent No. 75292/81 discloses: An appliance for transporting hot coke, in which a coke transport container is provided having a circular shape, tapering conically in the lower portion, and which is designed to be set into rotation during the filling operation, characterised in that a circular guide-rail is attached to an outer wall of the coke transport container, in the region of the conical taper, and in that at least four running-wheels are attached to a girder structure of a transport car associated with the said appliance, the coke transport container being set down on this car during the filling operation, and the spacing of the running-wheels being matched to the diameter of the circular guide-rail, at least one running-wheel being connected to a drive unit which is likewise attached to the girder structure.

However, the prior art has a disadvantages being that if a force smaller than the load resistance force (friction) loaded onto a plurality of free wheels is transmitted to only one driving wheel, the bucket will not rotate; only slippage will occur. For example, the bucket is very often susceptible to heat deformation due to the very high temperature of the hot coke so that the rails are also deformed having irregular surfaces, thus causing incomplete contact between the rails and the wheels. In this case, the bucket will not rotate at all. This problem may be solved by providing two or more driving wheels, but this will create an increased cost and size of the device. In order to increase the coke loading rate of the bucket, it is desired that the bucket is rotated consistently from the starting point of the bucket operation. In this sense the prior art cannot ensure the consistent rotation of the bucket due to the slippage and inertia inherent to the frictional rotation.

SUMMARY OF THE INVENTION

It is an object of the present invention to provide a hot coke receiving device having practical advantages, which improve the above stated shortcomings of the prior arts. According to the present invention, the ratio of the effective coke loading volume within the coke bucket can be increased; the weight of the coke bucket can be reduced at the time when the coke bucket rotates; and, in discharging the hot coke from the coke bucket, the hot coke can be discharged into the chamber in a uniformly distributed manner within the chamber in the circumferential direction thereof.

It is another object of the present invention to provide a hot coke receiving device which includes a rotary bucket that is designed to increase the effective coke loading volume within the coke bucket and a highly practical rotation device for turning the rotary bucket. More specifically, this invention, provides a hot coke receiving device of a type having a coke bucket body which has a cylindrical or polygonal form with a discharge gate provided in the bottom thereof, and having the coke bucket turnably mounted on a bucket car, said receiving device comprising: a ring-like horizontal frame surrounding the outer periphery of the coke bucket body without contact therebetween, said frame being connected to the discharge gate by means of a pair of rods and a pair of pins; a pair of outwardly projecting trunnions disposed at opposing points on the said ring-like horizontal frame; a pair of vertical hanger beams secured at opposing positions near but apart from the positions of said trunnions; said vertical beams having a projecting block which engages with said trunnion.

It is still a further object of the invention to provide an assembly of a rotary coke bucket and a bucket car for transporting hot coke to a dry quenching facility comprising: at least three ro1llers arranged on the upper surface of the bucket car in a circular configuration; a rotary arm with the rotating axis being identical to the center of the circular configuration of said rollers, said rotary arms having at both ends upward projections; driving means for rotating the rotary arm; a pair of semicircular rails, provided on each of two gate members forming the discharge gate provided on the bottom surface of the coke bucket; and a plurality of recesses formed on the bottom surface of the discharge gate to loosely engage with the upward projections of the rotary arms.

The details of the invention will become apparent from the following description of the embodiments thereof taken in connection with the accompanming drawings.

BRIEF EXPLANATION OF THE DRAWINGS

FIG. 3 schematically shows the ratio of the effective loading volume of coke to the total capacity of the bucket in the present invention.

FIGS. 4(*a*) and 4(*b*) are respectively a front view of the right and left half sections of the coke bucket with the discharge gate according to the present invention, and FIG. 4(*c*) is a side view of the same without the hanging mechanism.

DESCRIPTION OF THE PREFERRED EMBODIMENT

Figure 1A:
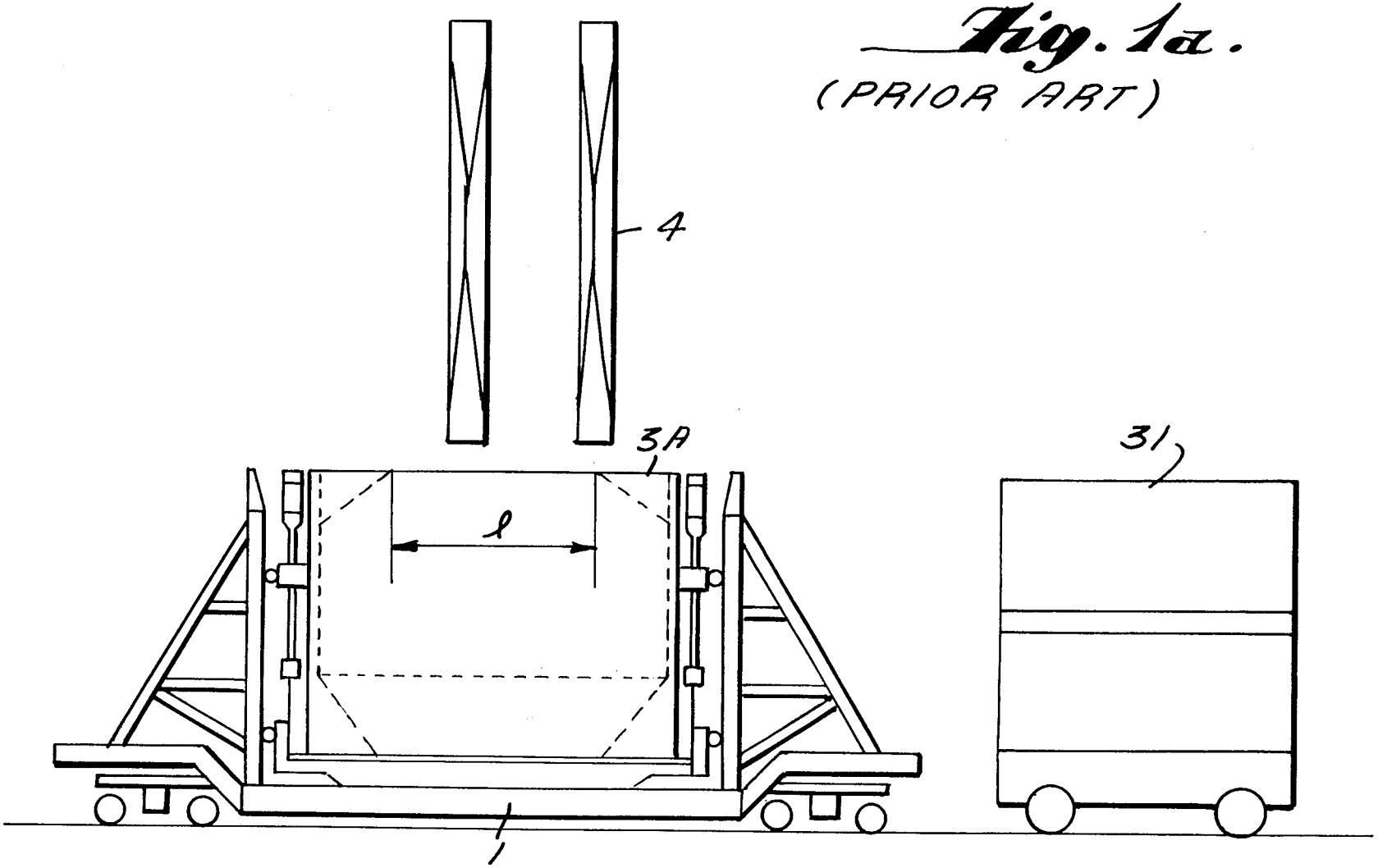
Fig. 1a. (PRIOR ART)
FIGS. 1(*a*) and 1(*b*) show the conventional arrangement of the coke bucket and the bucket car.
Figure 1B:
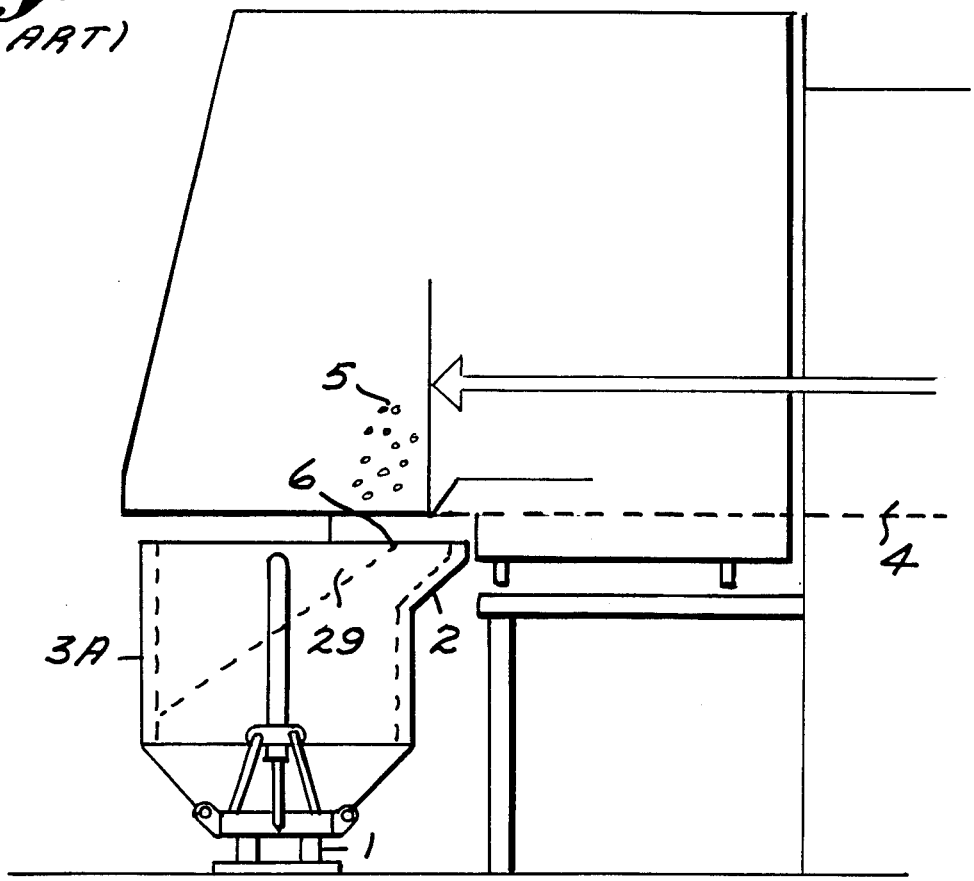
Fig. 1b. (PRIOR ART)
Figure 2A:
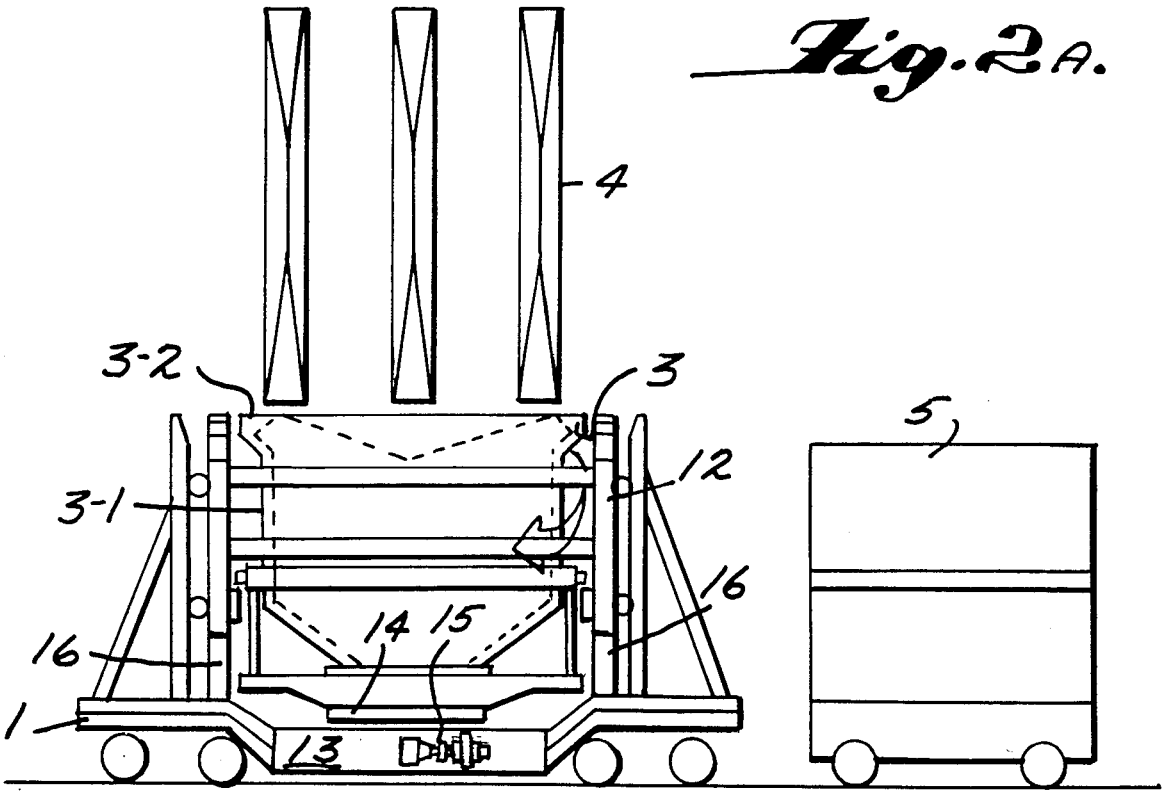
FIGS. 2(*a*) and 2(*b*) are front and side views showing the coke receiving device according to the present invention.
Figure 5A:
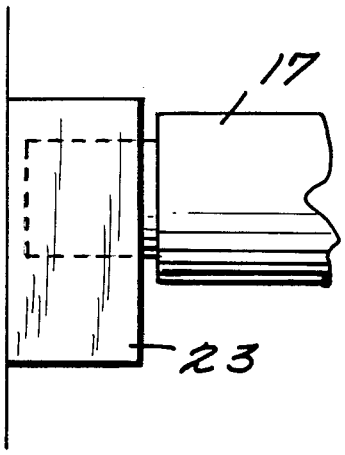
FIGS. 5(*a*), 5(*b*), 5(*c*) and 5(*d*) are front and side views showing the functions of the trunnions and the blocks.
Figure 5B:
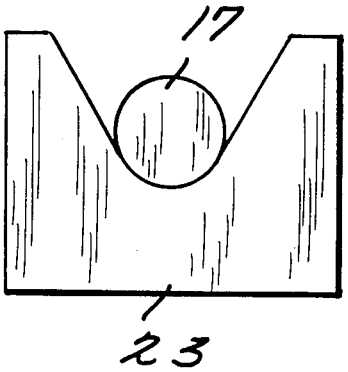
Figure 5C:
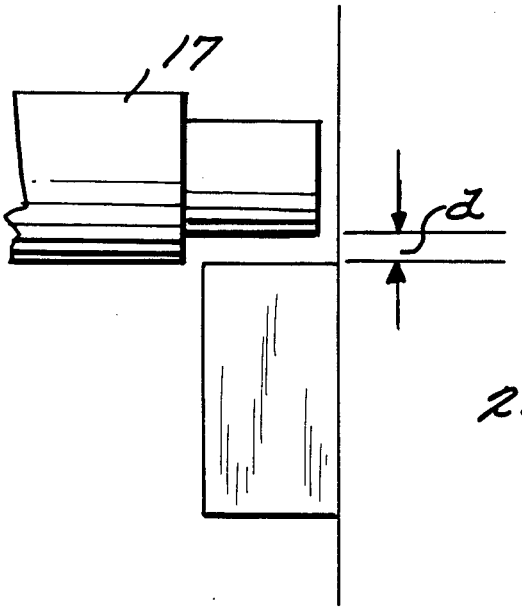
Figure 5D:
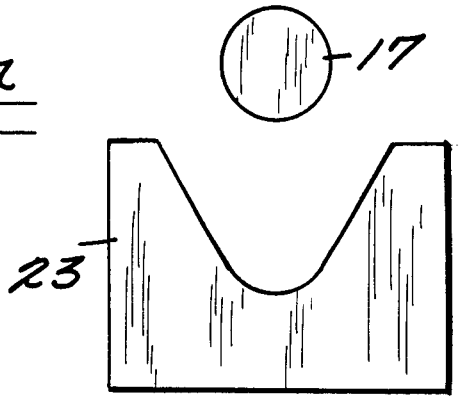

FIGS. 2(*a*) and 2(*b*) are front and side views showing an embodiment example of the present invention.

The coke bucket 3 which relates to the invention has its body 3-1 formed in a cylindrical or polygonal shape. The upper end part 3-2 of the bucket 3 is preferably expanded obliquely upward. A liner is applied to the inside of the bucket 3. The bottom of the bucket 3 is provided with a discharge gate 11 as shown in FIGS. 2(*a*) and 2(*b*).

Meanwhile, the bucket car 1 comprises a base frame 13 which is equipped with travelling members; a turning member 14 which is disposed on the base frame 13; a drive device 15 for turning the turning member 14; and a pair of vertical hanger beams supporting stand 16 which is mounted on the base frame 13.

For receiving hot coke with the invented device which is arranged as mentioned above, the cylindrical coke bucket 3, which is mounted on the turning member 14 is driven to rotate by the turning member while receiving the coke discharged from the coke oven. In the meantime, the bucket car is kept in a predetermined stationary position while the coke is being received into the bucket 3. FIG. 3 shows the coke bucket in a state after having been loaded with the coke.

As shown in FIG. 3, the ratio of the effective loading volume of coke to the total capacity of the bucket increases greatly. Compared with the conventional rectangular coke bucket designed to receive the same volume of coke, the weight of the coke bucket according to this invention can be reduced. Further, as apparent from FIG. 3, the coke bucket is not loaded with the coke in an unbalanced manner. This eliminates the necessity of using a balance weight and thus further contributes to a reduction in the weight of the coke bucket. In the drawing, a reference numeral 9 denotes the angle of repose.

The arrangement for hanging the coke bucket vertically by a crane and the opening and closing mechanism for the discharge gate 11 are similar to those of the conventional coke bucket. However, if the coke bucket is rotated on the turning member 14 together with the vertical hanger beams 12 having a guide roller device, the radius of rotation increases and might interfere with some other things or equipment in that relative area. In view of such a possibility, the coke bucket and the parts associated with the discharge gate are arranged to be turned around in another embodiment example which is as described below:

FIGS. 4(*b*) and 4(*c*) show the arrangement of the above stated embodiment in which: A discharge gate mechanism 11 is composed of a ring-shaped frame 19 having outwardly projecting trunnions 17 and downwardly extending brackets 18 attached thereto; connecting rods 20 extending from the brackets 18; discharge gate members 21; and gate hinges 22 which are jointed with the discharge gate members 21.

The vertical hanger beams 12 are completely separated from the coke bucket 3 and are each provided with a block 23 which has a V shaped groove on the upper side for catching the trunnion 17 as shown in FIGS. 5(*a*), 5(*b*), 5(*c*) and 5(*d*); and each provided with a vertical hanger beams 24 for the crane as shown in FIGS. 4(*a*) and 4(*b*). The hanger beams 12 are assembled in one unified body with the ring-shaped horizontal frame 25.

With the bucket hoisted down, the lower surface of the discharge gate 11 comes into contact with the turning member 14 of the bucket car. Then, the hanger beams 12 alone are lowered further until they are deposited on the hanger beam supporting stands 16 mounted on the bucket car. Under this condition, the ring-shaped frame 19 of the discharge gate 11 is in a state of being supported by the opening-and-closing connecting rods 20. The trunnions 17 and each of the blocks 23 of the hanger beams 12 are completely separated from each other with a clearance "a" formed between them as shown in FIG. 5(*c*). See FIGS. 5(*a*), 5(*b*), 5(*c*) and 5(*d*). Therefore, the coke bucket 3 and the discharge gate mechanism 11 become rotatable.

Upon completion of a coke receiving operation, the bucket car travels to a hoisting tower and stops. The crane hoists the hanger beams 12 upward. Then, as shown in FIG. 4(*a*), the blocks 23 catch the trunnions 17 of the discharge gate mechanism 11, and the coke bucket 3 is hoisted up via the connecting rods 20 and the discharge gate members 21 of the discharge gate mechanism 11. The gate is opened and closed above the chamber in the following manner with the coke bucket deposited on a fulcrum arranged on the chamber. Then, the crane is allowed to move downward. The weight of the gate and that of the hot coke cause the trunnions 17 to descend. The discharge gate members 21 open to charge the inside of the chamber with the hot coke.

Figure 6A:
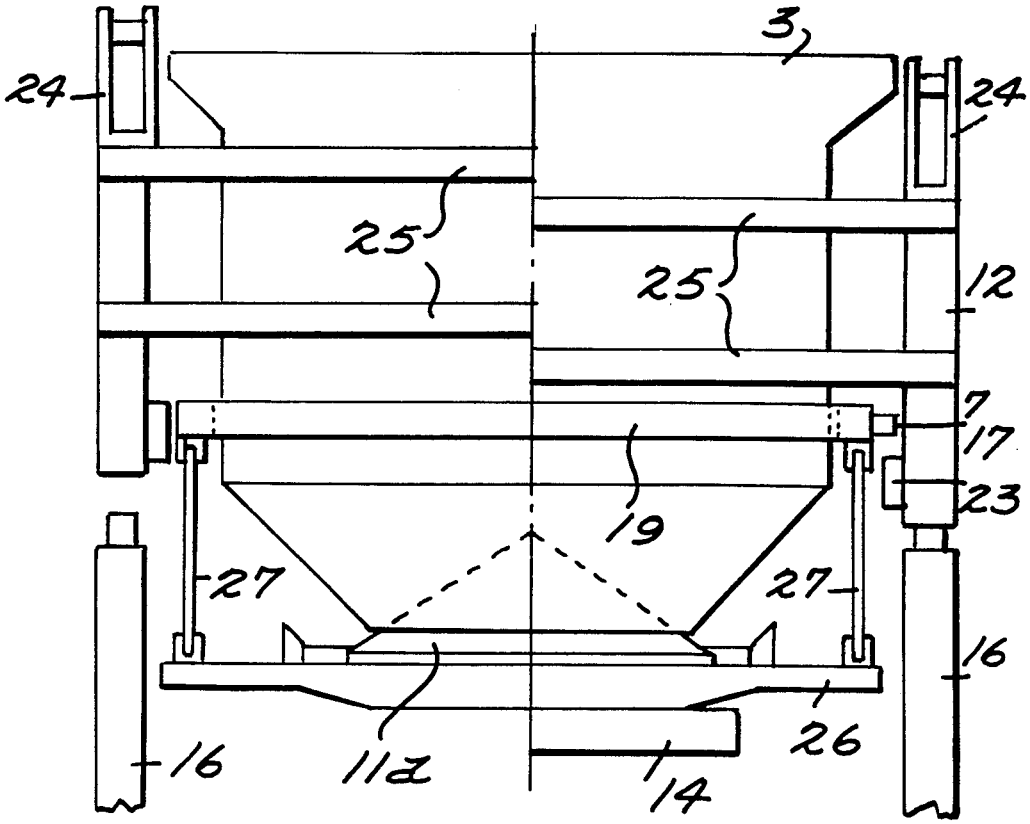
FIGS. 6(*a*) and 6(*b*) are front and side views of the cone-type discharge gate according to the present invention.
Figure 6B:
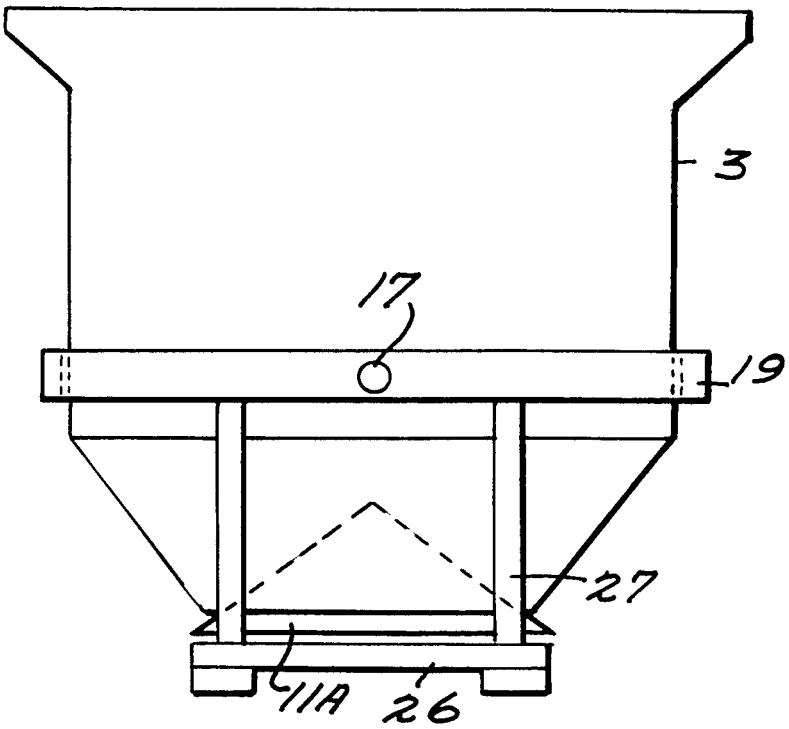

Next, in order that the hot coke is evenly distributed within the chamber, a conical gate discharge device 11A is arranged in an embodiment example of the invention in the following manner:

FIGS. 6(*a*) and 6(*b*) show the conical gate opening-and-closing device 11A. This device includes a ring-shaped frame 19; a trunninon 17 projecting from the frame; a gate frame 26, the middle part of which is formed into a conical shape; and connecting beams 27 which connect these parts to form one unified body. The coke bucket 3 is arranged in this case to be carried by the slanting portion of the conical shape.

The hanger beams 12 are arranged separately around the coke bucket 3 and the gate opening-and-closing device, to allow the bucket 3 to rotate on the upper surface of the turning member 14 in the same manner as mentioned in the foregoing.

Figure 7:
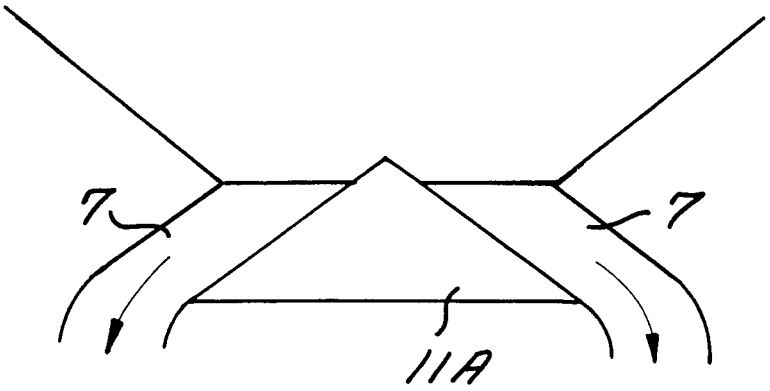
FIG. 7 is a front view of the cone-type discharge gate showing the coke discharge operation.
Figure 8A:
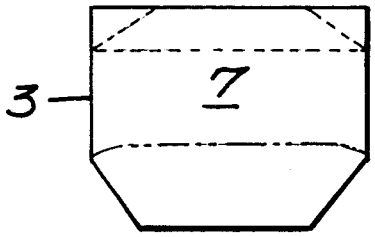
Fig. 8a. (PRIOR ART)
FIGS. 8(*a*) and 8(*b*) are respectively a cross-sectional view of the conventional coke bucket showing the coke loading condition in the bucket.
Figure 8B:
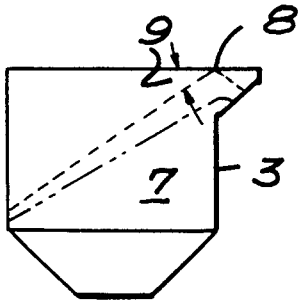
Fig. 8b. (PRIOR ART)

Upon completion of a coke receiving operation, the bucket car travels to the hoisting tower and stops. When the crane hoists up the hanger beams 12, the blocks 23 of the hanger beams catch the trunnion of the gate opening-and-closing device. The coke bucket 3 is then hoisted up via the connecting beams 27 and the conical slanting part of the opening-and-closing gate frame 26. The gate is opened and closed above the chamber in the following manner: The coke bucket 3 is deposited on a fulcrum which is arranged on the chamber. The crane is then allowed to move downwardly. Then, the weight of the gate and that of the hot coke causes the trunnion 17 to descend. With the trunnion thus descending, the hot coke is radially discharged to the inside of the chamber as shown in FIG. 7. Therefore, the hot coke can be evenly distributed within the chamber.

Figure 9:
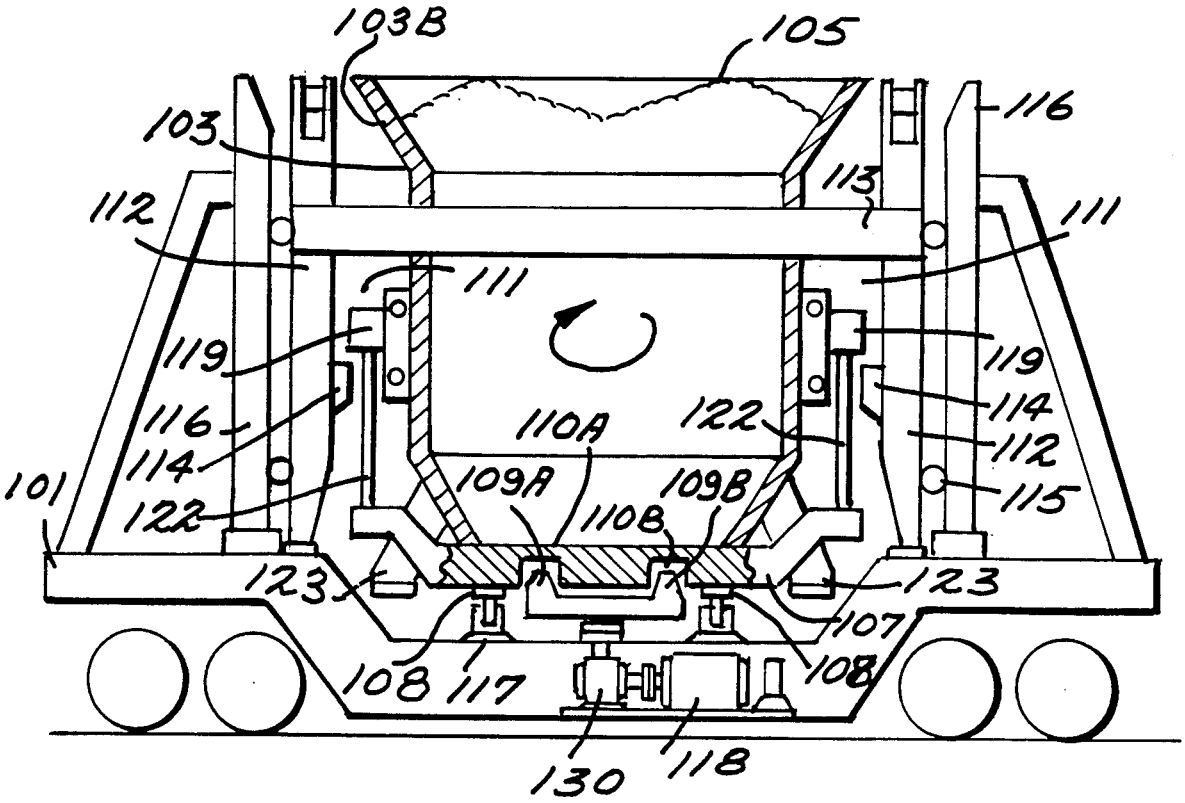
FIG. 9 shows partly in cross-section an embodiment of the coke receiving bucket rotatably located on the bucket car according to the present invention.
Figure 10:
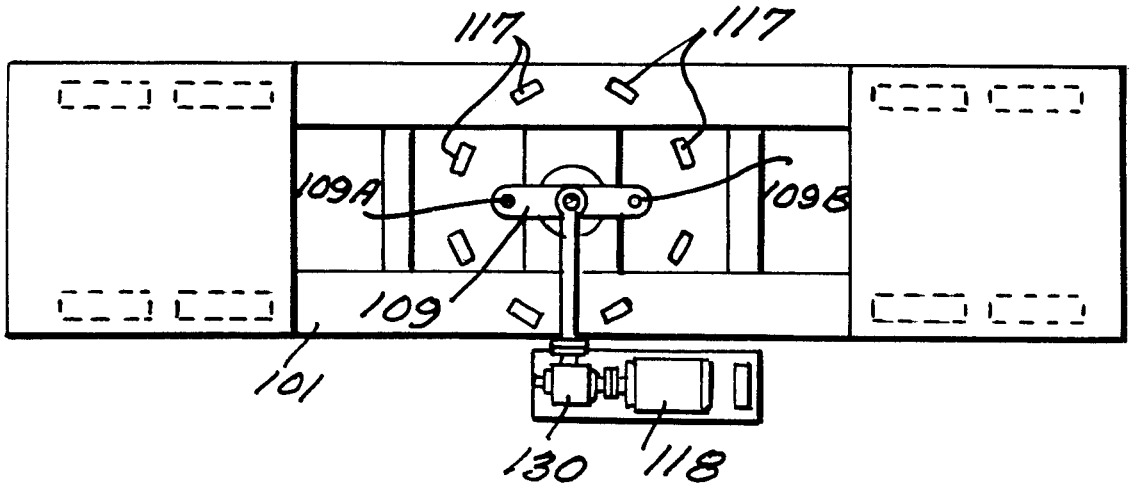
FIG. 10 is a plan view of the bucket car according to the present invention.
Figure 11:
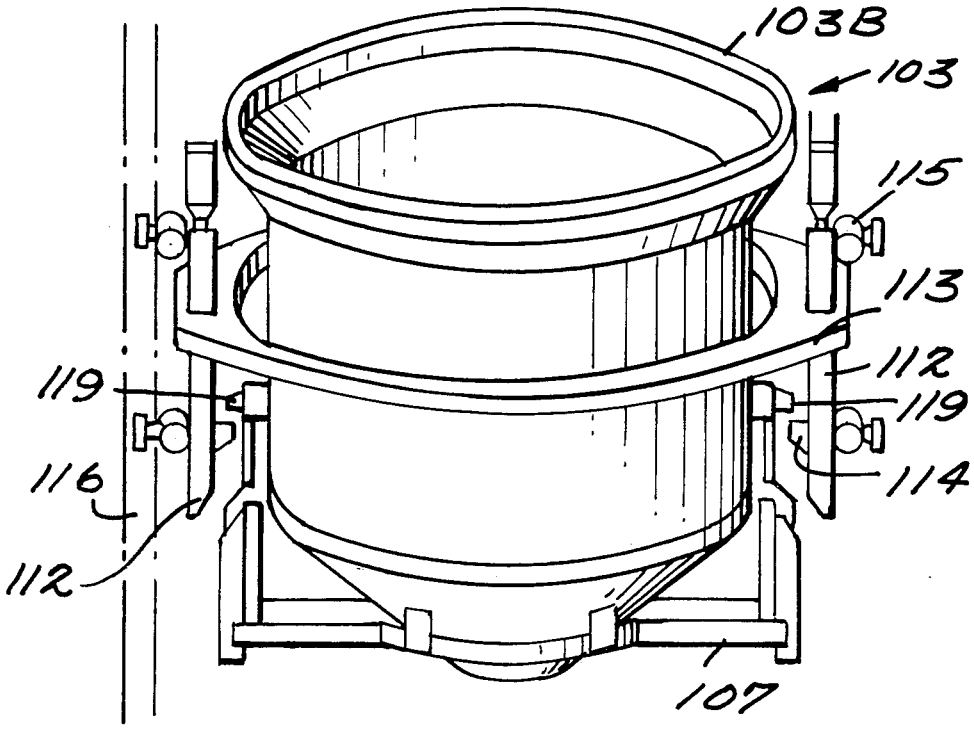
FIG. 11 is a slanted view of the coke bucket.

A modification example of the invention is arranged as shown in FIGS. 9, 10 and 11. FIG. 9 is a partly sectional front view showing this modification. FIG. 10 is a plan view showing a bucket car including a turning device arranged according to the invention. FIG. 11 is an oblique view showing by way of example a coke bucket arranged according to the invention. As shown in these drawings, the coke bucket 103 has a cylindrical or polygonal body. A liner is applied to the inside of the body. The upper end portion 103B of the bucket 103 expands obliquely upward. Discharge gate members 107 are arranged in the bottom part of the bucket. Semicircular rails 108 are laid on the bottoms of the discharge gate members 107 and are arranged to jointly form a ring-shape when the discharge gate members 107 are closed. When the coke bucket 103 is put on the bucket car 101, these semicircular rails 108 are placed on at least three receiving rollers 117 which are arranged on the bucket car in a ring-like configuration. A turning arm 109 which is disposed on the bucket car 101 is provided with upward projections 109A and 109B. These projections 109A and 109B are arranged to engage with recesses 110A and 110B which are provided in the bottom faces of the discharge gate members 107. A motor 118 and a power transmission device 130 are arranged on the bucket car 101 to cause the turning arm 109 to rotate. The turning arm then causes the coke bucket 103 to rotate with the recesses 110A and 110B fitted on the projections 109A and 109B. An arrangement in which the turning arm 109 is movable in the upward and downward directions via a spring, effectively prevents the turning arm 109 from being damaged by an inadequate setting.

In taking out hot coke from the coke oven, the bucket car 101 is moved to an applicable carbonization chamber where the coke bucket 103 is positioned. Then, while the coke bucket rotates, the hot coke is received in the bucket 103. In this modification example, the arrangement of the coke bucket to be hoisted up, is simplified. In causing the coke bucket to rotate, the weight of the bucket is reduced by virtue of the discharge gate operating mechanism 111 of the invention which is arranged across the axis of rotation of the bucket.

Figure 13:
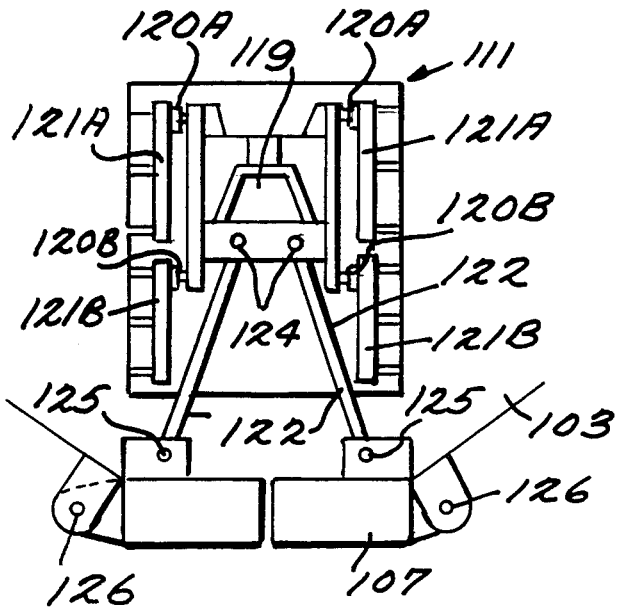
FIGS. 13-and 14 are respectively a front view and a side view of the modified discharge gate mechanism according to the present invention.
Figure 14:
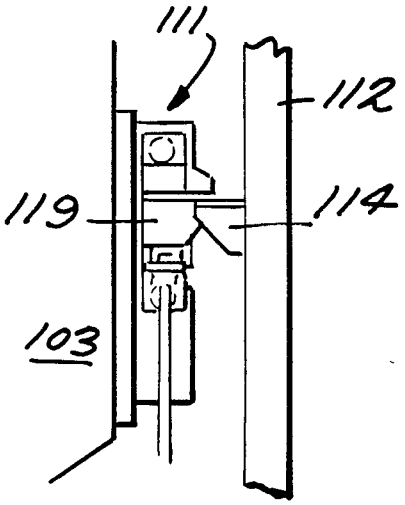

Referring to FIGS. 13 and 14, which show a modification of the discharge gate operating mechanism 111, the mechanism 111 is arranged as follows: Guide rails 121A and 121B are fixedly arranged to extend in the vertical direction. A catching block 119 is arranged between these guide rails 121A and 121B and is movable in the upward and downward directions. On the right and left sides of the catching block 119, wheels 120A and 120B are provided. The wheels 120A and 120B are guided by the guide rails 121A and 121B to be movable in the upward and downward directions. The wheels 120A which are disposed above the catching block 119 are guided by the guide rails 121A while the wheels 120B which are disposed below the block 119 are guided by the guide rails 121B when they move up and down.

The catching block 119 is connected to the discharge gate members 107 by two pins 124 and rods 122. The rods 122 are connected to the discharge gate members 107 by pins 125. The catching block 119 is thus connected to the pins 124 and 125, the rods 122 and the discharge gate members 107. Therefore, the catching block 119 serves also as a block for hanging up the coke bucket 103. Further, by moving the catching block 119 downwardly with the coke bucket 103 in a state of having its lower part fixed, the discharge gate members 107 can be opened. The discharge gate members 107 are pivotally attached to the coke bucket by pins 126.

Figure 12:
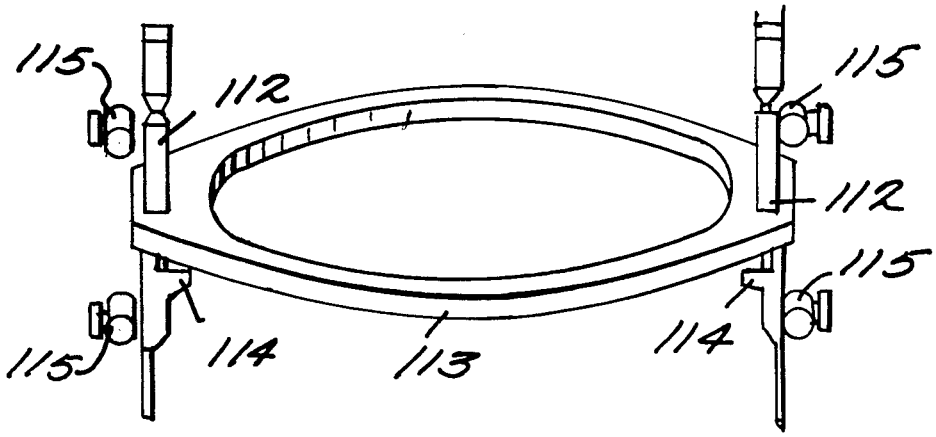
FIG. 12 is a slanted view of the vertical hanger beams according to the present invention.

As shown by way of example in FIGS. 11 and 12, hanger beams 112 are secured at opposing positions to two sides of a ring-shaped beam 113 which has a larger diameter than the outer diameter of the coke bucket 103 and is disposed along the outer circumference of the coke bucket. To the inner sides of the hanger beams 112 are secured hooks 114 which are arranged to engage with the above stated catching block 119. Guide rollers 115 are arranged on the rear sides of the hanger beams 112. When the hanger beams 112 are moved down, the guide rollers 115 are guided by the guide rails 116 secured to the bucket car 101 and determine the position of the coke bucket 103. These guide rollers 115 also serve to stabilize the coke bucket when the bucket car travels.

In receiving the hot coke with the receiving device of this embodiment, the bucket car 101 is brought to the discharge opening of the coke oven and the coke is received while the coke bucket 103 is being rotated in the same manner as described in the description of the foregoing embodiment examples. However, in this instance, the hooks 114 which are secured to the hanger beams 112 are located below the catching block 119 which is disposed within the discharge gate operating mechanism 111 and is away from the catching block 119. Therefore, the coke bucket 103 can be rotated without being hindered by the hooks 114. Upon completion of coke receiving, the coke bucket 103 ceases to turn. The bucket car 101 is moved to a dry quenching facility. A crane then hoists up the coke bucket to move it to a point above the pre-chamber of the dry quenching facility. In hoisting up the coke bucket 103, the hanger beams 112 are lifted up by the crane. The hooks 114 which are secured to the hanger beams 112 then engage with the catching blocks 119. With the hoisting action of the crane further continued, the coke bucket 103 moves upward and away from the bucket car 101.

The discharge gate is operated as follows: The coke bucket 103 which is hung up above the pre-chamber is lowered onto a supporting rack provided on the upper part of the prechamber. Legs 123 which are attached to the lower part of the coke bucket 103 as shown in FIG. 9 are then supported by the supporting rack and the weight of the coke bucket 103 is borne by the legs 123. When the lowering action of the crane further proceeds under this condition, the catching blocks 119 which are included in the discharge gate operating mechanism 111 are guided and move down along the guide rails 121A and 121B. As a result of that, the discharge gate members 107 are opened, turning on the pins 126 as shown in FIG. 13, by their own weight plus the weight of the hot coke. With the discharge gates thus opened, the hot coke is discharged into the pre-chamber. Upon completion of the discharge of the coke from the inside of the coke bucket, a lift-up action of the crane closes the discharge gate. With the lift-up action of the crane further continued, the coke bucket is again hoisted upward and then lowered back onto the bucket car 101. The details of the operation of placing the coke bucket 103 on the bucket car 101 are as follows: When the bucket 103 is lowered onto the car 101 from above, the guide rollers 115 which are provided on the rear sides of the hanger beams 112 as shown in FIG. 9 are guided by and come down along the guide rails 116 provided on the bucket car 101. Then, the bucket 103 is laid down on the car 101 with the rails 108, which are provided at the bottoms of the discharge gate members 107 and supported by the receiving rollers 117 which are arranged on the car 101. In this instance, the projections 109A and 109B of the turning arm 109 provided on the car 101 engage with the recesses 110A and 110B provided in the discharge gate members 107.

Following this, when the hanger beams 112 are further lowered, the hooks 114 disengage with the catching blocks 119. This brings the coke bucket 103 into a state of being carried solely by the receiving rollers 117 and then the bucket 103 thus becomes rotatable by the turning arm 109. The hanger beams 112 stops with the lower end thereof in contact with the car 101.

With the coke bucket 103 having been laid down onto the bucket car 101 and thus being in a rotatable state, the bucket 103 is completely separated from the hanger beams 112. Therefore, the bucket 103 can be reduced to a great degree both in size and weight for turning. As for the remaining parts of the mechanism for hoisting, included are only the catching blocks 119 and the guide rails 121A and 121B which are newly provided for the bucket.

Figure 15:
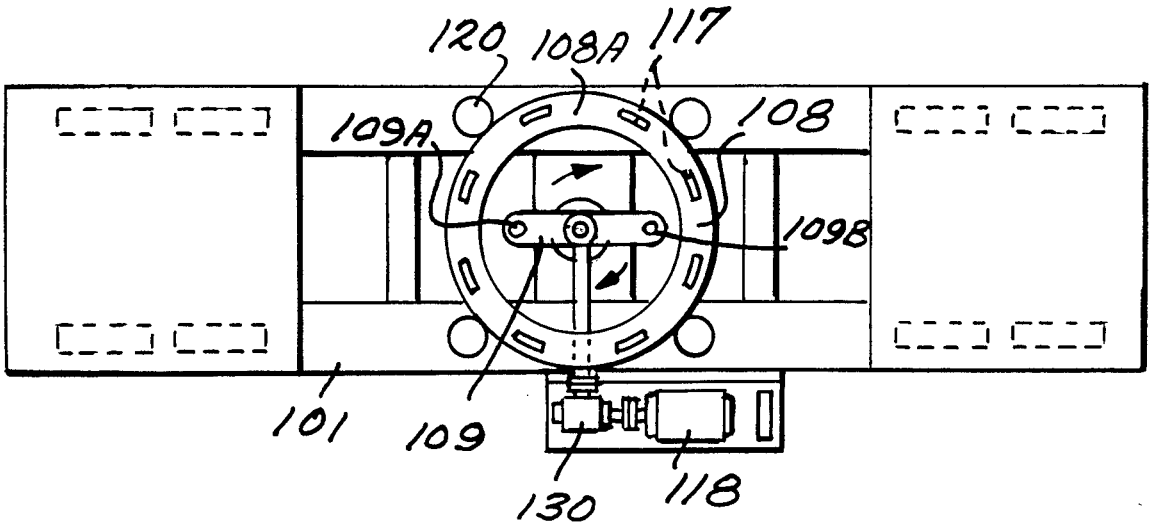
FIG. 15 is a plan view of the modified bucket car according to the present invention.

Further, description will be made on another modification of the present invention with reference to FIG. 15, showing the modification in a plane view.

The present modification is based on the coke bucket shown in FIGS. 9 to 11, and substitutes the semicircular rails 108, 108 provided on the bottom surface of the discharge gate with a complete circular shaped rail 108A supported on the rollers 117, 117, on which rail the coke bucket is to be mounted. With this modification, it is possible to reduce the weight of the coke bucket by the weight of the semicircular rails. In this embodiment, however, as the complete circular shaped rail is simply placed on the rollers 117, 117, the rail will likely disengage from the rollers during the rotation. In order to eliminate this tendency, three or more side rollers 120 are provided in this modification.

As mentioned above, in accordance with the invented coke bucket, the coke can be received by merely turning the minimum necessary portion of the coke bucket. The embodiment, therefore, can be used in a limited available space which is too narrow for the conventional rotary coke bucket. The invented arrangement also permits reduction in weight of the coke bucket driving part. In addition to these advantages, the embodiment described permits improvement upon the low effective loading volume ratio of the conventional rectangular bucket which has been considered inevitable, reduction in the weight of the bucket and reduction in the weight of the hanging load on the crane.

In the embodiment shown in FIG. 15 at least three side rollers 120 are arranged in the vicinity of the outer circumferential part of the rails 108 to prevent the rail 108 from deviating sideways while the rest of the arrangement of the embodiment is identical with that of the preceding embodiment example shown in FIG. 10.

The turning device according to the present invention requires only a simple turning arm engageable with the recesses which open downward in the bottom of the discharge gate. Therefore, a coke receiving operation can be carried out smoothly without any fear that the rotation function and the turning operation of the bucket might be affected by fallen coke, floating dust, etc.

The hot coke received by the coke bucket which is equipped with the invented bucket turning device is evenly loaded and will never be in a lop-sided loaded state within the coke bucket. This dispenses with any balance weight for balancing the total weight of the coke bucket and permits reduction in weight of the coke bucket.

In the device according to the invention, the ring-shaped rail is laid on a plurality of receiving rollers which are arranged in a ring-shaped configuration; and the coke bucket is placed on this rail to have the load of the coke bucket born by these rollers. This arrangement permits simplification of the structural arrangement and a smooth coke receiving operation excluding any possibility that the turning function and the turning movement of the bucket come to be affected by fallen coke, floating dust or the like.

What is claimed is:

1. In a hot coke receiving device of a type having a coke bucket body which has a discharge gate provided at the bottom thereof, and having the coke bucket body turnably mounted on a bucket car, wherein the improvement comprises:

a ring-like horizontal frame surrounding the outer periphery of the coke bucket body without contact therebetween, said frame being connected to the discharge gate by means of a pair of rods and a pair of pins;

a pair of outwardly projecting trunnions disposed at opposing points on the said ring-like horizontal frame;

a support frame surrounding said coke bucket body, a pair of vertical hanger beams secured at opposing positions on said support frame near but spaced from the positions of said trunnions;

each said vertical beam having a projecting block which engages with a said trunnion when said hanger beams are moved vertically.

2. A hot coke receiving device according to claim 1, wherein said support frame comprises a ring-like horizontal frame.

3. In a hot coke receiving device of a type having a coke bucket body which has a discharge gate provided at the bottom thereof and having the coke bucket body turnably mounted on a bucket car, wherein the improvement comprises:

vertical guide rails secured at opposing positions on the outer periphery of the coke bucket body;

a pair of catching blocks movable up and down along the guide rails and connected to the discharge gate via pins and rods;

a horizontal ring-like frame surrounding the coke bucket body without contact therebetween;

a pair of vertical hanger beams secured to said horizontal frame at opposing positions;

said hanger beams being vertically movable relative to said frame and each having a hook which engages with a said catching block upon said vertical movement.

* * * * *

UNITED STATES PATENT AND TRADEMARK OFFICE

CERTIFICATE OF CORRECTION

PATENT NO. : 4,683,031

DATED : July 28, 1987

INVENTOR(S) : Shoji KUTSUMURA; Touichi ISONAGA

It is certified that error appears in the above-identified patent and that said Letters Patent is hereby corrected as shown below:

On the title page, change item (73) to read--

--Fuji Car Manufacturing Co., Ltd.--

Signed and Sealed this

Fifteenth Day of June, 1993

*Attest:*

Michael K. Kirk

MICHAEL K. KIRK

*Attesting Officer*

*Acting Commissioner of Patents and Trademarks*